United States Patent [19]

Tippins et al.

[11] Patent Number: 4,782,683

[45] Date of Patent: Nov. 8, 1988

[54] HOT STRIP MILL SHAPE PROCESSOR AND METHOD

[75] Inventors: George W. Tippins; John E. Thomas, both of Pittsburgh; Ronald D. Gretz, Tarentum, all of Pa.

[73] Assignee: Tippins Incorporated, Pittsburgh, Pa.

[21] Appl. No.: 835,478

[22] Filed: Mar. 3, 1986

[51] Int. Cl.[4] ..... B21B 1/34; B21B 37/12; B21D 1/02

[52] U.S. Cl. ..... 72/229; 72/12; 72/164; 72/201

[58] Field of Search ..... 72/229, 205, 17, 12, 72/160, 161, 201, 10, 164

[56] References Cited

U.S. PATENT DOCUMENTS

| | | | |
|---|---|---|---|
| 2,105,736 | 1/1938 | Hudson | 72/160 X |
| 2,166,418 | 7/1939 | McBain | 72/161 X |
| 2,226,500 | 12/1940 | Matthews | 72/160 X |
| 3,344,637 | 10/1967 | Polakowski | 72/164 X |
| 3,839,888 | 10/1974 | Greenberger | 72/161 X |
| 4,316,376 | 2/1982 | Masui et al. | 72/164 X |
| 4,454,738 | 6/1984 | Buta | 72/164 X |
| 4,539,830 | 9/1985 | Noé et al. | 72/205 X |

FOREIGN PATENT DOCUMENTS

| | | | |
|---|---|---|---|
| 0202904 | 12/1982 | Japan | 72/161 |
| 0151919 | 9/1983 | Japan | 72/229 |
| 0094504 | 5/1984 | Japan | 72/161 |

*Primary Examiner*—Robert L. Spruill
*Assistant Examiner*—Steven B. Katz
*Attorney, Agent, or Firm*—Webb, Burden, Ziesenheim & Webb

[57] ABSTRACT

The method of controlling strip flatness on a hot strip mill which includes a hot reversing mill as a final reducing stand comprises reducing the thickness of the workpiece by passing it back and forth along a pass line through the hot reversing mill while reducing the roll gap on the mill after each successive pass. The strain developed during rolling is equalized by passing the workpiece through a shape processor having a plurality of upper and lower rolls capable of intermeshing along the pass line and located immediately downstream of the hot reversing mill. The equalizing of the strain through the shape processor occurs during selected intermittent passes and/or through the last pass through the reversing mill.

8 Claims, 1 Drawing Sheet

HOT STRIP MILL SHAPE PROCESSOR AND METHOD

BACKGROUND OF THE INVENTION

Field of the Invention

Our invention relates to hot strip mills and, more particularly, to hot strip mills employing a hot reversing mill having coiler furnaces on either side thereof as the final reducing stand and having a shape processor immediately downstream thereof.

Description of the Prior Art

Hot reversing mills for plate, sheet and strip having coiler furnaces on opposing sides thereof are employed in semicontinuous mills and as mini mills for processing metal slabs such as steel into a hot rolled product.

The flatness of strip or plate products produced on any type of hot strip mill is critical for most end use applications. The flatness of a strip or plate product produced on a hot reversing mill is particularly critical because a number of passes are taken on the same pair of work rolls and the mill operator does not have the option of decreasing roll crown from stand to stand as the mill operator has on the conventional hot strip mill with five or six finishing stands. The problem of flatness becomes accentuated where a single stand reversing mills comprises the entire mill since as many as 21 passes are subjected to the same crown of the two work rolls. Attempts have been made to develop variable crown rolls and/or employ roll bending, but these efforts have been costly and only marginally effective.

Stretch bend leveling has been employed in the making of very thin metal strip as exemplified by U.S. Pat. No. 4,539,830. Such a system is intended for extremely thin workpieces rolled at unconventionally high finishing temperatures, i.e. 1100° C., which is impractical if not impossible at the intended thickness. Another system for controlling the crowning of plate on a conventional hot strip mill is disclosed in unexamined published Japanese Patent Application No. 55-99611. In that system, an additional light reduction mill stand or plurality of mill stands are added after the final hot strip mill stands and a hot leveler is placed downstream of these auxiliary light reduction mill stands. The plate crown is controlled by changing the amount of crowning of the light reduction mill or mills and the distortion developed is corrected by the hot leveler.

SUMMARY OF THE INVENTION

Our shape processor and method provide the capability to roll coiled plate, coiled sheet and coiled strip product on a hot reversing mill to flatness levels far in excess of standard flatness tolerances.

Our shape processor and method permit selective imposition of a unique state of stress on hot rolled strip in order to create offsetting plastic strain to remove shape defects in hot rolled plate, sheet and strip products either before or after the defects have manifested.

The shape processor and method operate in-line and can impose tension, bending, tension plus bending, flexing or differential transverse bending stress states during or after roller to produce offsetting plastic strains to remove specific hot mill shape defects. The shape processor and method can be used in conjunction with reversing hot strip mills to effect in-line strip shape corrections during the hot strip rolling process or after the last pass in the process as a final modulation of overall strip shape. The shape processor and method are not sensitive to springback and produce a flat strip free of shape defects and having a low level of residual stress. The shape processor can be used to correct states of stress even before a shape defect appears.

The hot strip mill includes a hot reversing stand (e.g. Steckel Mill) as the final reducing stand. The hot reversing mill has coiler furnaces on the upstream and downstream sides thereof. The shape processor is positioned immediately downstream of the downstream coiler furnace and comprises a plurality of upper and lower rolls adapted to intermesh along a pass line. Appropriate pinch rolls and a hot coiler are also included. The workpiece being rolled is passed back and forth through the hot reversing mill while it is being reduced The workpiece is then directed through the shape processor to equalize the strain developed during rolling. This can occur after certain selected passes through the hot reversing mill or through the shape processor after a last pass through the reversing hot strip mill. The temperature of the work product through the shape processor is above the eutectoid decomposition temperature, 738° C., in most steels is above 815° C., and preferably for most steels is above 875° C., and the amount and form of induced stress are dependent on the shape condition of the workpiece.

DESCRIPTION OF THE PREFERRED EMBODIMENTS

Figure 1:
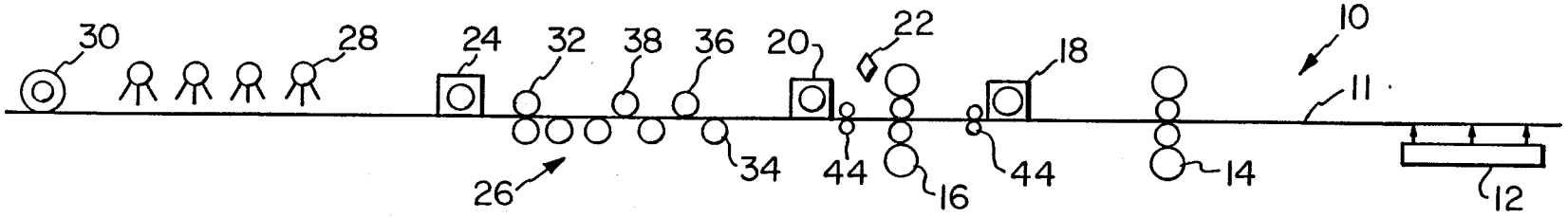
FIG. 1 is a schematic of the general arrangement of a hot strip mill embodying our invention.

Shape describes the deviation from flatness in sheet and strip. Bad shape can be characterized by a difference in strip length between the middle and edge of the strip. It has been shown that typically a strip with a long edge has a sinusoidal profile such that the strip length L, measured along the strip surface at the edge, can be expressed in terms of the length along the center, $l_0$ as:

$$L=l_0[1+(A\pi/2l_0)^2]$$

where A is the amplitude of the wave at the strip edge.

This equation can be rewritten in terms of strain ($\epsilon$) as follows: $\epsilon=(L-l_0/l_0)=(A\pi/2l_0)^2$ and the elongation difference between the center and edge of the strip or coiled plate can be expressed as a strain difference. The relation between stress and strain for a given material at a specific temperature is known, in the elastic range it is given by Young's modulus and in the plastic range by the modulus of plasticity. Thus, an applied state of stress can be used to produce a predictable and known strain condition.

We have found that a state of stress can be chosen in such a way as to offset shape defect producing differential elongations that occur in hot rolling strip or plate, and in so doing produce flat product having a low level of residual stress.

The greater elongation of the edge compared to the middle occurs because of the difference between the actual roll gap shape and the cross-sectional shape of the strip. Bad shape localized in parts of the strip can be due to uneven coolant application to the rolls causing hot bands on the roll surface or localized thermal camber. Excluding causes of bad shape that can be avoided by good mill design and maintenance, the remaining operational variables have to do with an accurate description of the work rolls in relation to the exact transverse roll gap opening:

1. ground in crown on rolls;
2. thermal crown of rolls;
3. wear of surface of rolls; and
4. deflection under load of rolls.

In addition, the above variables change from pass to pass and each pass also becomes conditional on the history of the prior passes.

It is well known and generally appreciated that defects are caused by differences in elongation of the strip. The overall shape of the strip is determined by differential yielding as the strip accommodates these elongations. In some cases, residual stresses located in the strip may be too small to cause buckling during rolling, but if the strip is slit longitudinally, when cold, it may bend and distort to accommodate the residual stresses over the new cross-sectional area.

The flow stress of the metal is influenced by factors unrelated to the deformation process as well as factors explicitly related to the deformation process. Those factors unrelated to the deformation process include chemical composition, metallurgical structure, phases, grain size, segregation and prior strain history. The factors the subject invention is directed to are those related to the deformation process, such as temperature, strain and strain rate.

At temperatures above the phase transformation temperature, the influence of strain rate upon flow stress is small. We utilize our method at temperatures down to a minimum of 738° C. which is the eutectoid decomposition temperature. The preferred temperature range is above the two phase region and varies with carbon content. For plain carbon and high strength low alloy steels, temperatures on the order of 815° C. and preferably 875° C. and higher are employed These latter temperatures are employed for the final pass through the hot reversing mill and higher temperatures are employed where an intermediate product is passed through the shape processor.

The resistance to deformation is typically a multiple of the yield stress during the finishing passes of hot rolling, with the yield stress itself changing with temperature and strain rate. Shape correction methods that operate on the strip in the roll gap are therefore subject to the flow behavior of the metal being determined by the resistance to deformation which typically is several times the yield stress. Outside the roll gap, shape correction is controlled by the yield stress alone, and the stress required to produce a given strain and result in yielding is several times less than inside the gap. Therefore, shape correction outside the roll gap is inherently more efficient, as long as the strip is hot.

Because of the yield point elongation phenomenon in carbon steels, shape correction at ambient temperature is subject to inhomogeneous deformation with consequent coil breaks, Luder's lines and related surface quality defects. As temperature increases, the ability of the metal to store elastic energy begins to falol very sharply. The phenomenon of recrystallization provides strain relief. Within that context, time and temperature are the critical variables which are known for any given chemistry. Our process supplements this phenomenon or replaces the phenomenon in materials where recrystallization is not available, e.g. A.P.I. grades and high strength low alloy grades.

The parallel fiber model can be used to best explain the effect of rolling on shape. In the parallel fiber model of a wide strip, one assumes that the strip is made of a great number of narrow strips each free to assume its own length. Transverse variations in roll gap shape due to the bending of the rolls from the separating forces, when combined with crown on the incoming strip, impose a difference in actual reduction for each elemental fiber. Each fiber has a different elongation and each fiber is assumed to be free to assume its own length. In actual fact, the elements are not free to assume their own length because the interface between fibers can support a shear stress. However, the net overall shape of the strip is the result of these constraints accommodating the state of stress over the cross section, developing a specific state of residual stress. The state of stress is balanced across the strip width with tension and compression areas offsetting each other.

As soon as the strip exits the roll gap, the roll force load is removed from the strip and a new accommodation process occurs to develop a new state of stress outside the roll gap. This state of stress created in the strip undergoes relaxation by the complex phenomenon of recrystallization of the metal with a release of heat energy which is dependent on temperatures composition, grain size, work hardening and prior reduction. The effect of this may be a shape change and/or a state of residual stress.

In the parallel fiber model, the essential feature to produce good shape or flat strip is to operate on the state of stress after the secondary deformation adjustment occurs on exit from the roll gap. This in turn involves bringing the strip to the yield point to effect changes in fiber length and produce offsetting changes in strip shape to produce a flat strip. Different shape defects are representative of different states of stress, each with characteristics state of stress requiring a unique yielding strategy to produce optimum results.

Our shape processor effects controlled yielding outside the roll gap in any one of five ways which include:

1. along a transverse line across the strip width;
2. by extension of all parallel fibers;
3. by combined transverse and longitudinal yielding;
4. yielding over an area of the strip; and
5. differential bending across the width.

These options can be used sequentially or in varied combinations to create equalization of fiber lengths to optimize achievement of flat strip. Our method is particularly useful on alloys where precipitation occurs at temperatures above the phase transformation. The shape processor permits rapid shape correction on the hot strip line and still permits cooling without delay to optimize mechanical properties.

A complete hot strip mill 10 is illustrated in FIG. 1. A reheat furnace 12 provides slabs onto a table roll conveyor 11 which also defines the pass line for the slabs to be reduced.

A four high hot reversing roughing mill 14 is positioned downstream of furnace 12 and receives the slab and reduces the slab to an intermediate thickness workpiece through a series of back and forth flat passes.

Downstream of the roughing mill 14 is hot reversing mill 16. Positioned upstream of and adjacent to hot reversing mill 16 is coiler furnace 18, and positioned just downstream of and adjacent to hot reversing mill 16 is coiler furnace 20. A pair of pinch rolls 44 are located adjacent the entry of the coiler furnaces 18 and 20, respectively. A shape detector 22 is positioned over the pass line and immediately downstreeam of the hot reversing mill 16.

The shape processor 26 is downstream of and adjacent to the coiler furnace 20, and coiler furnace 24 is further downstream of and adjacent to shape processor 26. Proceeding in a downstream direction from coiler furnace 24 are the standard cooling means 28 and final coilers, in this case an upcoiler 30.

Figure 2:
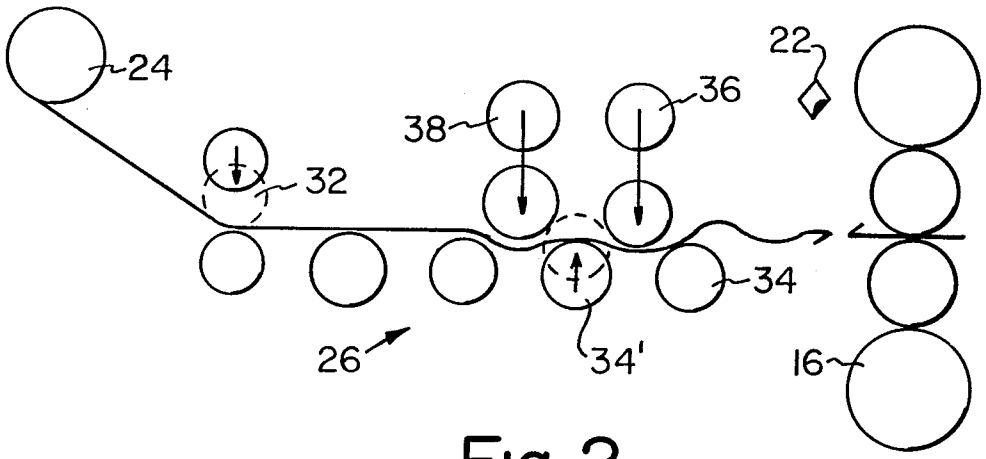
FIG. 2 is an enlarged schematic showing the shape processor of our invention.

The details of the shape processor can best be seen in FIG. 2. The shape processor includes a double roll set, rolls 36 and 38, located above the pass line, both of which can be moved to intermesh with the pass line. Bottom table rolls 34 make up the lower portion of shape processor 26, and lower roll 34', which is located between rolls 36 and 38, can be raised into the pass line to further work in conjunction with one or both of rolls 36 and 38. A pinch roll 32 is downstream of the double rolls 36 and 38 and located at the entry to the coiler furnace 24. The pinch roll 32 at the entry of the coiler furnace 24 can be used in conjunction with the mill exit pinch roll 44 (FIG. 1) to exert strip tension. The intermesh of the double rolls 36 and 38 with the roller table provides for strip bending. The double rolls 36 and 38 can be tilted by known mechanisms to produce a single bend for moderate shape correction.

Figure 3:
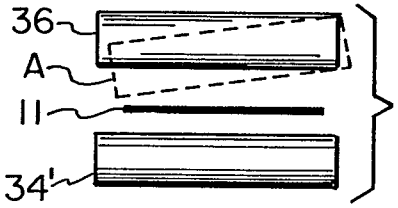
FIG. 3 is a front view of a portion of the shape processor shown in FIG. 2.

FIG. 3 shows how the double rolls 36 and 38 are tiltable in a plane transverse to the pass line 11, with the tilted position of roll 36 shown in dashed lines and identified by reference letter A. The double rolls can be spaced horizontally and the lower roll 34' can be raised between these double rolls to permit forced contour of the strip to the radius of the curvature of the table roll with or without applied tension.

The shape processor 26 can be used in five ways. The first is a simple transverse strip bending in which the double rolls intermesh with the table. This can be used with or without tilt at shallow or deep intermesh. The shape processor 26 can also be used in simple tension with pinch rolls 32 and 44 contacting the strip and the double rolls 36 and 38 lifted away from the table. The shape processor 26 can also be used in combined tension and bending by having an intermesh of the double rolls 36 and 38 with the pinch rolls 32 and 44 down. The shape processor 26 can also be used to achieve strip flexing which can be created by positioning the double rolls 36 and 38 down and separated to accommodate the lower roll 34' which is raised. Finally, the shape processor can be used to achieve differential transverse bending.

The shape detector 22 can be utilized to monitor the shape coming out of the reversing mill 16 to provide the mill operator with information to manually cause the strip to go through the shape processor 26. Alternatively, the shape detector can provide an automatic signal to cause the strip to be fed through the shape processor 26 under the appropriate strain conditions. Shape detectors capable of measuring differential thicknesses across a strip and other types of shape detectors are known in the art and the details of those detectors do not form a part of this invention.

A typical pass sequence for a single stand mill is illustrated in Table 1 as follows. The mild carbon steel slab of 9.840 inches (0.250 m) by 50 inches (1.270 m) is reduced to a coil plate of 0.125 inch (3.175 mm) by 50 inches (1.270 m).

TABLE 1

| | Pass Schedule | | | | | |
|---|---|---|---|---|---|---|
| | Gauge | | Draft | | Reduction | Temp. |
| Pass No. | in. | mm | in. | mm | % | °C. |
| 0 | 9.843 | 250.012 | — | — | — | — |
| 1 | 8.661 | 219.989 | 1.181 | 29.997 | 12.00 | 1146 |
| 2 | 7.480 | 189.992 | 1.181 | 29.997 | 13.64 | 1118 |
| 3 | 6.299 | 159.995 | 1.181 | 29.997 | 15.79 | 1103 |
| 4 | 5.118 | 129.997 | 1.181 | 29.997 | 18.75 | 1093 |
| 5 | 3.937 | 100.000 | 1.181 | 29.997 | 23.08 | 1085 |
| 6 | 3.150 | 80.010 | 0.787 | 19.990 | 20.00 | 1099 |
| 7 | 2.283 | 57.988 | 0.866 | 21.996 | 27.50 | 1097 |
| 8 | 1.654 | 42.012 | 0.630 | 16.002 | 27.59 | 1084 |
| 9 | 0.827 | 21.006 | 0.827 | 21.006 | 50.00 | 978 |
| 10 | 0.469 | 11.913 | 0.358 | 9.093 | 43.33 | 941 |
| 11 | 0.283 | 7.188 | 0.185 | 4.699 | 39.50 | 888 |
| 12 | 0.177 | 4.496 | 0.106 | 2.692 | 37.50 | 843 |
| 13 | 0.125 | 3.175 | 0.053 | 1.346 | 30.00 | 816 |

In the pass schedule of Table 1, the first seven or eight passes are considered the roughing mode and would be carried out on the roughing mill 14 of mill 10 of FIG. 1. The workpiece being rolled could conveniently be sent through the shape processor after the eighth pass (by dumming the mills) and could be coiled in the coiler furnaces after the ninth pass. The final product can again be sent through the shape processor, if necessary.

We claim:

1. A method of controlling strip flatness on a hot strip mill including a hot reversing mill as the final reducing stand comprising:

(a) reducing the thickness of a workpiece by passing it back and forth along a pass line through the hot reversing mill while reducing a roll gap on said mill after each successive pass; and (b) equalizing the strain developed during rolling whether or not a shape defect appears by passing the workpiece at a temperature above an eutectoid decomposition temperature of the strip through a shape processor having a plurality of upper and lower rolls that intermesh along the pass line said upper rolls comprising at least a roll pair adjustable in the vertical direction and tiltable in a plane transverse to the pass line and a lower roll positioned intermittent the roll pair and adjustable in the vertical direction, said shape processor located immediately downstream of and separate from the hot reversing mill, said equalizing of the strain occurring after certain selected passes through the hot reversing mill, said shape processor equalizing the strain by subjecting the strip to one of transverse bending, simple tension, tension and bending, strip flexing and differential transverse bending.

2. The method of claim 1 including passing the strip through the shape processor after a last pass through the reversing hot strip mill.

3. The method of claim 1 including passing the strip through the shape processor after at least one intermediate pass through the reversing hot strip mill.

4. The method of claim 1 including passing the workpiece back and forth through the hot reversing mill in flat passes and then back and forth through the hot reversing mill between coiler furnaces located on either side of the hot reversing mill.

5. The method of claim 1 including passing a workpiece through the hot reversing mill, the shape processor and then coiling the workpiece downstream of the shape processor prior to passing the workpiece back through the hot reversing mill.

6. The method of claim 1 including detecting a flatness irregularity prior to equalizing the strain.

7. A hot strip mill including:

(a) a hot reversing mill as the final reducing stand and having a coiler furnace on the upstream and the downstream sides thereof;

(b) a shape processor positioned immediately downstream of the downstream coiler furnace and comprising a plurality of upper and lower rolls adapted to intermesh along a pass line, said upper rolls having at least a roll pair adjustable in the vertical direction and tiltable in a plane transverse to the pass line and at least a lower oll positioned intermittent each roll pair and adjustable in the vertical direction, a pinch roll and a coiler; and (c) cooling means downstream of the shape processor whereby said shape processor receives a workpiece from the mill after a final and/or intermediate pass and equalizes strain developed in the workpiece during rolling.

8. The hot stirp mill of claim 7 including a shape detector positioned upstream of the shape processor.

* * * * *